United States Patent [19]

Tsuchida

[11] Patent Number: 4,620,705

[45] Date of Patent: Nov. 4, 1986

[54] RACKET STRINGING DEVICE

[75] Inventor: Akira Tsuchida, Higashikurume, Japan

[73] Assignee: Asics Corporation, Osaka, Japan

[21] Appl. No.: 716,376

[22] Filed: Mar. 26, 1985

[30] Foreign Application Priority Data

Mar. 26, 1984 [JP] Japan ..... 59-56286

[51] Int. Cl.[4] ..... A63B 51/14

[52] U.S. Cl. ..... 273/73 A; 254/231

[58] Field of Search ..... 273/73 A, 73 B; 73/862.43, 862.42, 862.44; 74/89.15; 254/231, 236, 362, 250, 251

[56] References Cited

U.S. PATENT DOCUMENTS 3,635,080 1/1972 Krueger et al. ..... 273/73 A
3,913,912 10/1975 Smith ..... 273/73 A
3,918,713 11/1975 Kaminstein ..... 273/73 A

FOREIGN PATENT DOCUMENTS 55-116365 9/1980 Japan .
55-116366 9/1980 Japan .
56-106667 8/1981 Japan .

*Primary Examiner*—Richard C. Pinkham
*Assistant Examiner*—Matthew L. Schneider
*Attorney, Agent, or Firm*—Wenderoth, Lind & Ponack

[57] ABSTRACT

A gut stringing device for stringing a tennis racket or the like which permits accurate adjustment of a tension applied to the string. The device has a threaded screw and a nut mounted on it. Slide plates carrying a string clamp are moved by driving the threaded screw. Simultaneously a lever coupled to the nut swings against the bias of a spring until it touches a limit switch set at a desired pound value. The limit switch stops a motor driving the threaded screw.

6 Claims, 5 Drawing Figures

RACKET STRINGING DEVICE

BACKGROUND AND OBJECTS OF THE INVENTION

The present invention relates to a racket stringing device used to tighten a string such as gut, being strung on a tennis racket or the like.

It is desired that a string be strung on a tennis racket at tension adequate to the player who uses the racket. If the tension is not adequate, he could not play satisfactorily. Therefore, a player often feels the necessity of adjusting the tension of the string on a tennis racket. This requires a special racket stringing device.

Various types of racket stringing devices have been used including hydraulic and pneumatic ones. FIG. 1 shows a conventional racket stringing device which comprises a base A, support arms B pivotally mounted on the base, clamps C mounted on the support arms for securing a racket, and a weight D mounted on a lever E. The lever is tilted by the weight D to pull one end of the racket. On this device, the position with the lever tilted is maintained by a ratchet (not shown). Therefore, a desired tension cannot be obtained accurately. With other hydraulic or pneumatic devices, accurate adjustment is impossible. Further, such devices are too expensive for amateur players.

An object of the present invention is to provide a racket stringing device which permits accurate adjustment of tension on the string and which is inexpensive to manufacture.

The device according to the present invention makes it possible to adjust the tension of the string accurately and quickly to a desired pound value. Electrically operated, it can be manufactured at a low cost in comparison with hydraulically or pneumatically operated devices.

BRIEF DESCRIPTION OF THE DRAWINGS

Other objects and advantages of the present invention will become apparent from the following description taken with reference to the accompanying drawings, in which.

DETAILED DESCRIPTION OF THE PREFERRED EMBODIMENT

Figure 1:
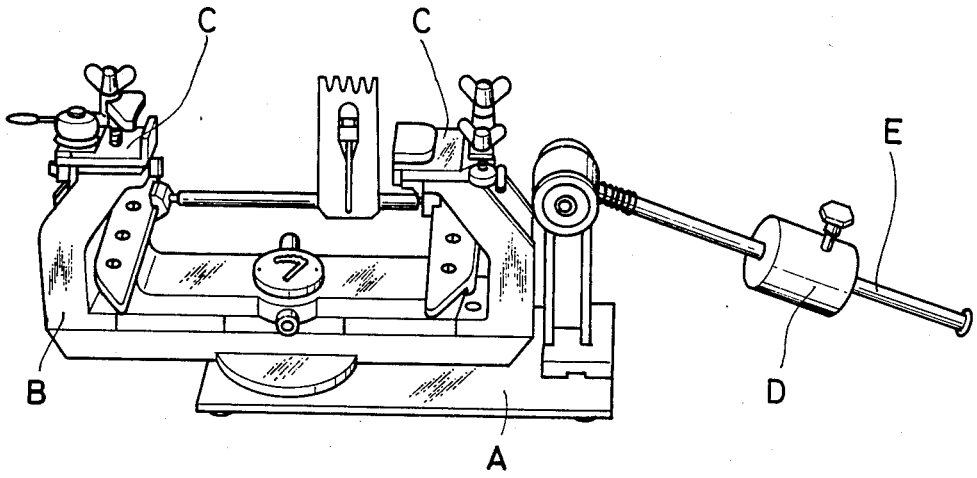
FIG. 1 PRIOR ART
FIG. 1 is a perspective view of a prior art device.
Figure 2:
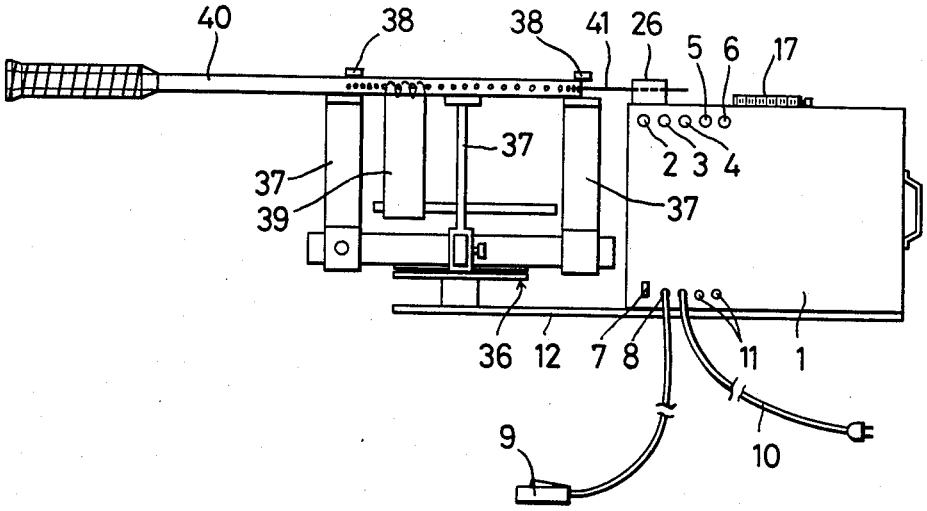
FIG. 2 is a front view of the device embodying the present invention.
Figure 3:
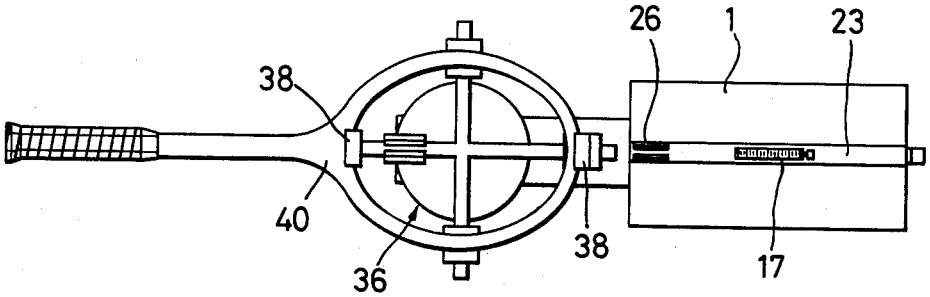
FIG. 3 is a plan view thereof.

Referring to the drawings, on a casing 1, lamps 2–6 are provided. The lamp 2 indicates that a main switch 7 is on. The lamp 3 indicates that the device is in operation. The lamp 4 indicates that a motor has been stopped by a limit switch. The lamp 5 indicates that no tension is applied to the string or the tension to the string has not reached a preset pound value. The lamp 6 indicates that the device is ready for resetting. A foot pedal switch 9 is connected to a terminal 8. Reference numeral 10 designates a power cord, 11 designates a fuse, and reference 12 designates a base. (FIG. 2)

Figure 4:
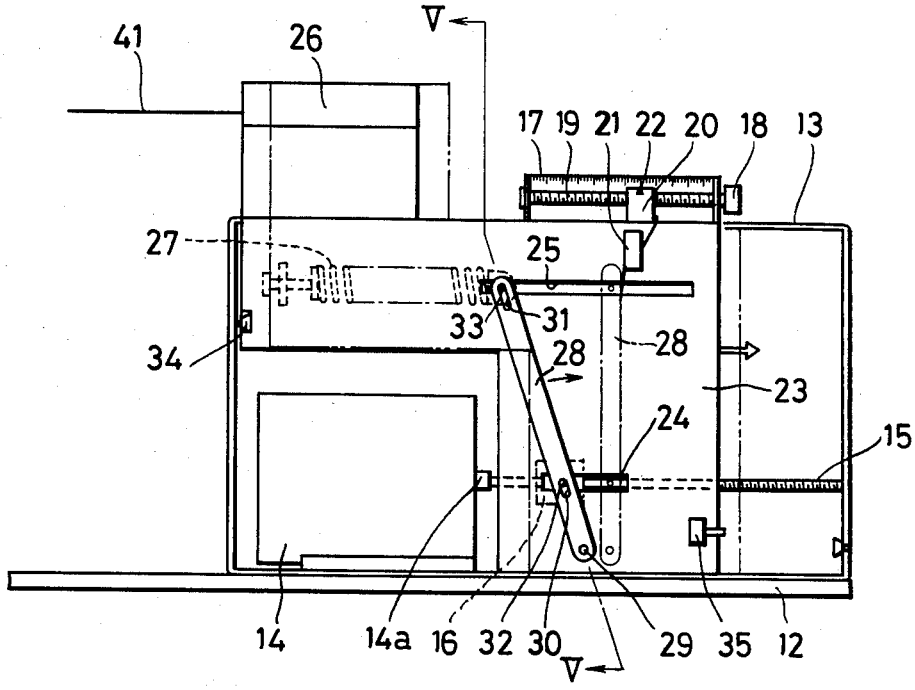
FIG. 4 is a front view of the device with the cover removed.
Figure 5:
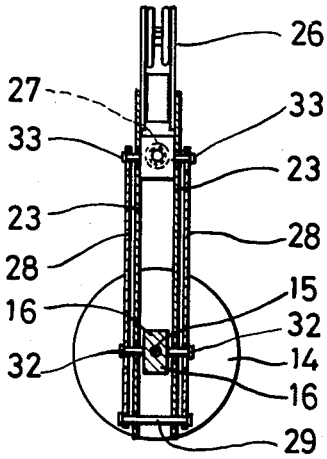
FIG. 5 is a sectional view thereof taken along the line V—V in FIG. 4.

A guide frame 13 is secured to the base 12 to guide slide plates 23 in a horizontal direction. A reversible motor 14 is secured to the base 12. A threaded screw 15 is fixedly coupled to a rotary shaft 14*a* of the reversible motor 14. A nut 16 threadedly engages on the threaded screw 15. (FIG. 4)

A scale 17 graduated in pounds is secured to the slide plates 23 and has an upside down U- shaped section. The scale 17 has a threaded screw 19 with a knob 18 at one end thereof. The screw is turnably mounted between a pair of walls. A nut 20 threadedly engages the threaded screw 19 and carries a limit switch 21. A pointer 22 is on the nut 20.

The slide plates 23 are supported by the guide frame 13 and guided thereby so as to slide along the guide frame in a horizontal direction. The slide plates 23 are formed with slits 24, 25 (FIG. 4) extending in the direction in which the slide plates 23 slide.

A string clamp 26 is secured to the top of the slide plates 23 to securely hold one end of the string to be strung. A coil spring 27 has one end secured to the slide plates 23 and the other end secured to one end of levers 28 (FIG. 4). The levers have their bottom end pivoted on the slide plates through pins 29. The levers 28 are formed with slits 30 and 31 to receive coupling pins 32 and 33, respectively. The pin 32 is provided on the nut 16 to couple the nut with levers 28. The pin 33 is provided at one end of the coil spring 27 to couple the lever 28 to the coil spring.

Limit switches 34, 35 are provided at each end of the travel of the slide plates 23. A racket fixing means 36 comprises support arms 37 turnably mounted on the base 12, a clamp 38, and a string clamp 39. The racket fixing means may be any commercially available one.

Reference numeral 40 designates a racket and reference numeral 41 a string.

In use, a racket 40 is firstly secured by means of the racket fixing assembly 36 and one end of string 41 is clamped on the string clamp 39. The foot pedal switch 9 is turned on to actuate the reversible motor 14 to turn the threaded screw 15. As the screw rotates, the nut 16 move rightwardly on FIG. 4.

As noted above, nut 16 is coupled to levers 28, the upper ends of the levers 28 are connected to the plates 23 through the spring 27 and the bottom ends of levers 28 are connected to the plates 23 through pin 29. Initially, string 41, fixed to plates 23 through clamp 26, is loose so that the levers 28, pin 29, spring 27 and plates 23 are carried incrementally rightward with the nut 16. This tightens the string 41.

After the string has become tight with a tension sufficient to expand the spring 27, the slide plates 23 can move only slightly under the load from the string. Because the reversible motor 14 is still on, the levers 28 start to pivot around the pin 29 against the bias of the coil spring 27. As the levers pivot, the slide plates 23 will move for a slight distance to a position shown with a dotted line on FIG. 4 to pull the string with a predetermined pound value.

When the levers 28 touch the limit switch 21 which has been placed at the preset pound value, the reversible motor 14 will stop instantly. In this state, racket stringing work is performed. When the reversible motor 14 stops, the slide plates 23 will be prevented from returning in a reverse direction owing to resistance by engagement between the threaded screw 15 and the nut 16. This eliminates the need for a special brake for the slide plates. When the foot pedal switch 9 is depressed, the reversible motor 14 will rotate in a reverse direction to move the nut to the original position. Now the device has been reset.

What I claim:

1. A racket stringing device, comprising:

a base;

a slide plate slidably mounted on said base for movement in a direction;

a reversible motor;

a threaded screw fixedly coupled to said reversible motor for being reversably rotated thereby;

a string clamping means, fixedly mounted on said slide plate, for clampingly receiving a string to be strung on a racket;

a lever having one end pivotally mounted on said slide plate, said slide plate being formed with first and second slots extending in said direction, said lever being formed with third and fourth slots;

means, fixed to said lever, for threadably engaging said threaded screw;

a first pin extending through said first slot and said third slot and a second pin extending through said second slot and said fourth slot so as to loosely couple said lever to said slide plate at said first and second slots; and spring means, having one end secured to said slide plate and another end secured to the other end of said lever, for elastically connecting said other end of said lever to said slide plate.

2. A racket stringing device, comprising:

a base;

racket clamping means, attached to said base, for securing a racket in place;

a slide plate slidably mounted on said base for movement in a direction;

a reversible motor;

a threaded screw fixedly coupled to said reversible motor for being reversably rotated thereby;

a string clamping means, fixedly mounted on said slide plate, for clampingly receiving a string to be strung on a racket;

a lever having one end pivotally mounted on said slide plate, said slide plate being formed with first and second slots extending in said direction, said lever being formed with third and fourth slots;

means, fixed to said lever, for threadably engaging said threaded screw;

a first pin extending through said first slot and said third slot and a second pin extending through said second slot and said fourth slot so as to loosely couple said lever to said slide plate at said first and second slots; and spring means, having one end secured to said slide plate and another end secured to the other end of said lever, for elastically connecting said other end of said lever to said slide plate.

3. A device as in claim 2, further comprising means for detecting arrival of said slide plate at a first preset position and stopping said reversible motor upon detecting said arrival.

4. A device as in claim 3, wherein said detecting means comprises means for detecting arrival of said other end of said lever at a second preset position defining a preset tension in said spring means and thereby the string being strung.

5. A device as in claim 4, wherein said other end arrival detecting means comprises a limit switch and means for actuating said limit switch, adjustably mounted on said slide plate so as to be positionable along said direction and on said other end of said lever, such that said limit switch is actuated by said actuating means when said other end of said lever arrives at said second preset position, the position of said limit switch corresponding to said second preset position.

6. A device as in claim 5, wherein said limit switch is mounted on said other end of said lever and said actuating means comprises an actuating member for engaging said limit switch when said other end of said lever arrives at said second preset position, said actuating member being movably mounted on a graduated scale, said scale being mounted on said slide plate and extending in said direction.

* * * * *